US005259132A

United States Patent [19]

Leonard

[11] Patent Number: 5,259,132

[45] Date of Patent: Nov. 9, 1993

[54] DAILY CALENDAR APPARATUS FOR THE POOR SIGHTED

[76] Inventor: James J. Leonard, 12 Walker St., Patterson, N.J. 07501

[21] Appl. No.: 911,393

[22] Filed: Jul. 10, 1992

[51] Int. Cl.[5] ..... G09D 3/00

[52] U.S. Cl. ..... 40/107; 40/122; 283/2

[58] Field of Search ..... 40/107, 109, 122; 283/2, 3, 4

[56] References Cited

U.S. PATENT DOCUMENTS

| | | | |
|---|---|---|---|
| 296,934 | 4/1884 | Cussons | 40/122 |
| 2,447,807 | 8/1948 | Lathrop | 40/107 |
| 2,828,564 | 4/1958 | Barbin | 40/122 |
| 3,564,741 | 2/1971 | Kahre et al. | 40/107 |
| 4,136,473 | 1/1979 | Coe | 40/109 X |

FOREIGN PATENT DOCUMENTS

| | | | |
|---|---|---|---|
| 2826507 | 1/1980 | Fed. Rep. of Germany | 283/2 |
| 947071 | 6/1949 | France | 40/122 |

*Primary Examiner*—Kenneth J. Dorner
*Assistant Examiner*—J. Bonifanti

[57] ABSTRACT

An apparatus for displaying daily calendar information. It comprises show pieces, and a holder. The show pieces bear calendar information, and when the show pieces are placed in the correct position the current day, date, month, and year will be displayed. The information size will be large enough to be seen from a distance by the user. The apparatus must be adjusted each day to show the current day, and date. At the change of the months, and year the show pieces that carry this information will require adjustment. The holder while keeping the show pieces secure, allows for adjustment and viewing.

1 Claim, 1 Drawing Sheet

DAILY CALENDAR APPARATUS FOR THE POOR SIGHTED

BACKGROUND OF THE INVENTION

This invention relates to calendars, and in particular to displaying the current day, date, month, and year in large type.

Poor sight prevents many people from seeing monthly calendars because the printing is small and the distance to the calendar may be to far. Some people with sight problems lose track of time from not being able to see the calendar. This is more evident in the senior population, and loss of sight through aging may be associated to memory loss. Nursing, Veterans old age, retired Firemans, etc. . . . Homes use large cutouts of calendar information which are attached to walls in rooms, or hallways where they can be seen by the residents, or patients who can not see regular sized type. Calendars are updated daily by the residents or an attendant from a supply of cut-outs usually stored nearby.

In banks and some other public places they use tear off calendars that have the date in large type, but the day, month, and year is in smaller size. These type calendars produce a sheet of scrap paper each day contribute to the waste disposal problems in the U.S.A.

Until now the displaying of the complete date information (date, day, month, and year) in large size, and in a compact setting has not been solved in any practical, and convenient way . . .

Prior Art: Cussons 296934, Lathrop 2447807, Barbin 2828564, Kahre et al 3564741, Coe 4136473, (Country France) O.E.M. 947071 (Country Germany) Frey 2826507

SUMMARY OF THE INVENTION

The apparatus of my invention are show pieces preferably cards with which daily calendar information can be shown. A primary distinguishing feature of my invention is that only the current days calendar information will show when the show pieces are adjusted correctly.

Another feature of my invention is that all the show pieces are stored in the apparatus.

Another feature of my invention is that the bearings on the show pieces can be large enough so as to be visable to most people with poor sight.

Another feature is that even with large bearings of the data the apparatus would be of a practical size.

Another feature is that it is easy to adjust the apparatus.

Another feature is that with only nine show pieces the invention has the ability to display the daily calendar information for two years (Starting January 1 of the first year and ending December 31 of the following year), and by replacing the year show piece it will continue to display for two more years, and so on.

An object of my invention is that it would be helpful to those with poor sight.

Another object is that the adjusting of the apparatus on a daily basis would be therapeutic to a persons memory.

DESCRIPTION OF THE DRAWINGS

My invention is best understood by the following description, and by the drawings in which of my invention.

DETAILED DESCRIPTION OF THE PREFERRED EMBODIMENT

In the preferred embodiment of my invention there are nine show pieces, and a holder.

Figure 1:
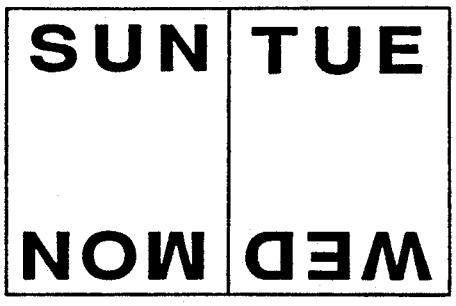
FIG. 1 is a schematic view of the first show piece.

As seen in FIG. 1 a show piece that has a width (W) and a height (H), and a thickness (C). For example (W) is 8.5,(H) is 11, and (C) 0.026 inch. On this show piece "SUN", "MON","TUE",&"WED" are located on the upper and lower quarters on each side (¼ H).

Figure 2:
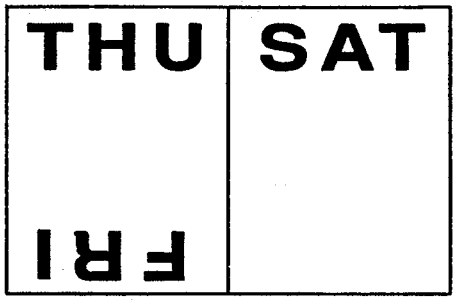
FIG. 2 is a schematic view of the second show piece.

As seen in FIG. 2 "THU","FRI" are located on the upper and lower quarters of one side. "SAT" is located on the other side on the upper quarter. This show piece is the same size as FIG. 1.

Figure 3:
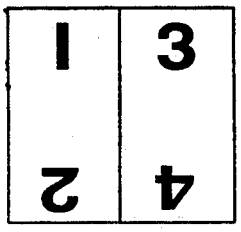
FIG. 3 is a schematic view of the third show piece.
Figure 4:
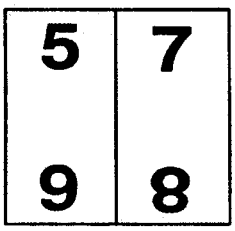
FIG. 4 is a schematic view of the fourth show piece.

As seen in FIG. 3 a show piece that is three quarters of the height (¾ H), one half of the width (½ W), and the same thickness as FIG. 1. This show piece has the digits "1", "1","2","3",&"4" located in the upper and lower thirds (⅓ H) on both sides, one in each. As seen in FIG. 4 a show piece the same size as FIG. 3. This show piece has the digits "5","6","7",&"8" located on the upper and lower thirds of both sides, one in each.

Figure 5:
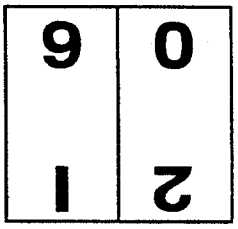
FIG. 5 is a schematic view of the fifth show piece.
Figure 6:
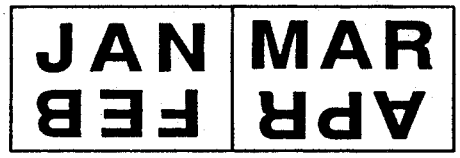
FIG. 6 is a schematic view of the sixth show piece.

As seen in FIG. 5 a show piece the same size as FIG. 3. This show piece has the digits "9","1","0",&"2" located on the upper and lower thirds of both sides, one in each As seen in FIG. 6 a show piece one half the height, (½ H), the same width, and the same thickness as FIG. 1. This show piece has "JAN","FEB","MAR",&"APR" located in the upper and lower halves of both sides, one in each.

Figure 7:
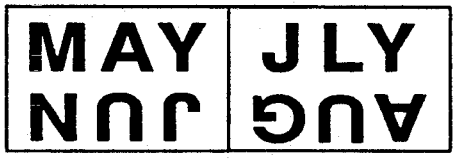
FIG. 7 is a schematic view of the seventh show piece.

As seen in FIG. 7 a show piece the same size as FIG. 6. This show piece has "MAY","JUN","JLY",&-"AUG" located in the upper and lower halves of both sides, one in each.

Figure 8:
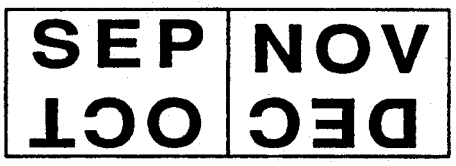
FIG. 8 is a schematic view of the eighth show piece.

As seen in FIG. 8 a show piece the same size as FIG. 6 This show piece has "SEP","OCT","NOV",&"-DEC" located in the upper and lower halves of both sides, one in each.

Figure 9:
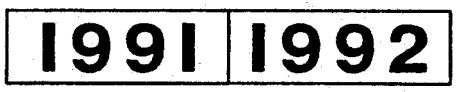
FIG. 9 is a schematic view of the ninth show piece.

As seen in FIG. 9 a show piece one quarter of the height (¼ H), and the same width and thickness as FIG. 1. This show piece has the year number "1991" on one side, and the year number "1992" on the other side.

As seen in FIGS. 1–8 the bearings are orientated to read upright when in the upper position.

Figure 12:
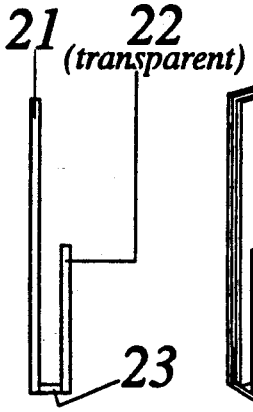
"
FIG. 12 is a schematic view of the holder.
Figure 13:
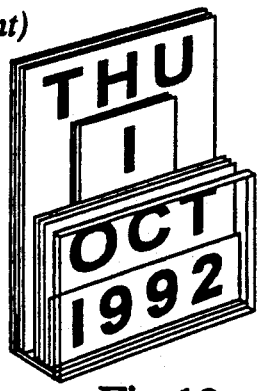
FIG. 13 is an isometric view.

As seen in FIG. 12 a holder in the form of a channel. The holder has a back plate (21), a front plate that is transparent (22), and a base plate (23). The holder is (W) width. The height of the back plate is (H), and the front plate is (½ H) measured from the top of the base plate. The base plate is (9 C) thick.

THE GENERAL MANNER OF USING THE CALENDAR APPARATUS IS AS FOLLOWS:

Place the nine show pieces in the holder so that the first show piece FIG. 1 is touching the holder back plate (21). The second show piece is put in front of the first, and so on until the ninth show piece is touching the front plate of the holder (22) and they all rest on the holder base plate (23). Parts of the second FIG. 2, the fifth FIG. 5, the eighth FIG. 8, and all of one side of the ninth FIG. 9 will be visible.

Figure 10:
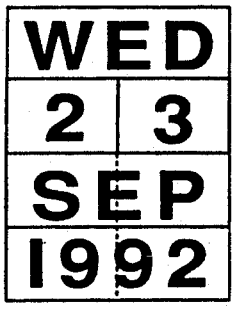
FIG. 10 is a perspective view displaying "WED 23 SEP 1992

Now that the show pieces are in the holder the manner of using them is: (To display the date seen in FIG. 10 "WED 23 SEP 1992") slide the first FIG. 1 out from behind the second FIG. 2 and place it in front of the second having "WED" show in the upper quarter of the apparatus; Next slide the third show piece FIG. 3 from behind the fourth FIG. 4 since the third is only one half the width it can be placed in the right half of the apparatus, have the "3" show above the month, then move the fifth which is also one half the width to the left half of the apparatus and have the "2" show, let the third and fifth overlap slightly to maintain the nine show piece thickness; Next have the eighth which is in position show "SEP" FIG. 8; Next have the ninth show piece show "1992" FIG. 9.

Figure 11:
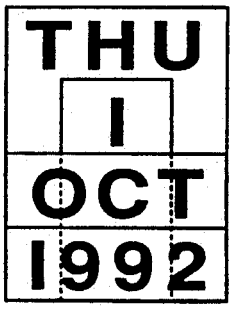
"
FIG. 11 is a perspective view displaying "THU 1 OCT 1992

(To display FIG. 11 "THU 1 OCT 1992") Slide the second from behind the first and show "THU" in the upper quarter of the apparatus; next line up the third, fifth, and fourth in the center of the apparatus and have the "1" on the third FIG. 3 below "THU"; next rotate the eighth show piece which is in position to show'-'OCT"; "1992" is showing on the ninth show piece.

For convenience, cards are preferred, but in general tiles or the like can be used.

It should be understood that the preferred embodiment as described is just illustrative of my invention and that no limitations to the scope of my invention are intended except those defined in the claims that follow.

What is claimed is:

1. A calendar apparatus comprising, in combination:

first through ninth show pieces, each having first and second sides for bearing indicia thereon;

said first show piece having full size height and width, bearing four different days of the week, said first show piece having one day on each upper and lower quarter on each side thereof;

said second show piece, being substantially the same size as said first show piece, bearing the remaining three days of the week, having one day on the upper quarter of one side, one day on the lower quarter of the same side and one day on one of the upper and lower quarters of the second side thereof;

said third show piece, being substantially three quarters of the height and one half of the width of said first show piece, bearing four digits from the following group of twelve digits: 1, 2, 3, 4, 5, 6, 7, 8, 9, 0, 1, 2, having one on each upper and lower third of each side thereof;

said fourth show piece, being substantially the same size as said third show piece, bearing four digits from the eight remaining digits from the group, having one of said digits on each upper and lower third of each side thereof;

said fifth show piece; being substantially the same size as said third show piece, bearing the remaining four digits from the group, having one of said digits on each upper and lower third of each side thereof;

said sixth show piece, being substantially one half the height and the same width as said first show piece, bearing four different months of the year, having one month on each upper and lower half of each side thereof;

said seventh show piece, being substantially the same size as said sixth show piece, bearing four different months of the year than the months on the sixth show piece, having one month on each upper and lower half of each side thereof;

said eighth show piece, being substantially the same size as the sixth show piece, bearing the remaining four months of the year, having one month on each upper and lower half of each side thereof;

said ninth show piece, being substantially one quarter the height and the same width as said first show piece, bearing the numbers of two years, having one year on each side thereof; and a holder, comprising a transparent front plate, a back plate and a base plate, said front plate being perpendicularly attached to said base plate along one side thereof and said back plate being perpendicularly attached to said base plate along the opposite side thereof so as to be parallel to said front plate, said front plate being substantially the same height and width as said sixth show piece, said back plate being substantially the same height and width as said first show piece, and said base plate being substantially the same width as said first show piece and substantially the same depth as the thicknesses of the first through ninth show pieces combined, wherein said first through ninth show pieces may be arranged within said holder to display a variety of dates.

* * * * *